US008618953B2

(12) United States Patent
Morimoto

(10) Patent No.: US 8,618,953 B2
(45) Date of Patent: Dec. 31, 2013

(54) ROADSIDE-TO-VEHICLE COMMUNICATION SYSTEM AND DRIVING SUPPORT SYSTEM

(75) Inventor: Kazuhiro Morimoto, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 2 days.

(21) Appl. No.: 13/574,725

(22) PCT Filed: May 12, 2011

(86) PCT No.: PCT/JP2011/060975
§ 371 (c)(1),
(2), (4) Date: Jul. 23, 2012

(87) PCT Pub. No.: WO2012/153420
PCT Pub. Date: Nov. 15, 2012

(65) Prior Publication Data

US 2013/0135117 A1 May 30, 2013

(51) Int. Cl.
*G08G 1/09* (2006.01)

(52) U.S. Cl.
USPC ..... 340/905; 340/901; 340/995.13

(58) Field of Classification Search
USPC ..... 340/905, 903, 901, 995.13, 991; 370/328, 389
See application file for complete search history.

(56) References Cited

U.S. PATENT DOCUMENTS

| | | | | |
|---|---|---|---|---|
| 4,823,138 | A * | 4/1989 | Shibano et al. | 342/457 |
| 6,307,484 | B1 * | 10/2001 | Sasaki et al. | 340/903 |
| 7,133,768 | B2 * | 11/2006 | Mukaiyama | 701/400 |
| 7,843,869 | B2 * | 11/2010 | Ikawa et al. | 370/328 |
| 8,059,013 | B2 * | 11/2011 | Aono | 340/905 |
| 8,412,107 | B2 * | 4/2013 | Hamada et al. | 370/389 |
| 8,483,903 | B2 * | 7/2013 | Tengler et al. | 340/435 |
| 2006/0193282 | A1 * | 8/2006 | Ikawa et al. | 370/328 |
| 2011/0260886 | A1 * | 10/2011 | Nagura et al. | 340/905 |

FOREIGN PATENT DOCUMENTS

| | | |
|---|---|---|
| JP | 2001 93085 | 4/2001 |
| JP | 2009 42918 | 2/2009 |
| JP | 2009 116579 | 5/2009 |
| JP | 2010 3306 | 1/2010 |
| JP | 2010 33581 | 2/2010 |
| JP | 2010 277358 | 12/2010 |
| JP | 2011 34158 | 2/2011 |

OTHER PUBLICATIONS

International Search Report Issued Aug. 16, 2011 in PCT/JP11/60975 Filed May 12, 2011.

* cited by examiner

*Primary Examiner* — Eric M Blount
(74) *Attorney, Agent, or Firm* — Oblon, Spivak, McClelland, Maier & Neustadt, L.L.P.

(57) ABSTRACT

Disclosed is a roadside-to-vehicle communication system which allows a vehicle, which is traveling within a roadside-to-vehicle communication area, to receive signal information from a roadside device multiple times. The roadside-to-vehicle communication system includes determination means for determining whether or not new information is added to the signal information transmitted from the roadside device, and update means for, only when the determination means determines that the new information is added to the signal information, updating the signal information which is used on the vehicle side. With this configuration, it is possible to reduce the processing load on the signal information even when the signal information is received multiple times through roadside-to-vehicle communication.

5 Claims, 2 Drawing Sheets

ROADSIDE-TO-VEHICLE COMMUNICATION SYSTEM AND DRIVING SUPPORT SYSTEM

TECHNICAL FIELD

The present invention relates to a roadside-to-vehicle communication system and a driving support system which allows a vehicle, which is traveling within a roadside-to-vehicle communication area, to receive signal information from a roadside device multiple times.

BACKGROUND ART

For example, when an infrastructure cooperative service is provided at each service-target intersection, infrastructure information is received through roadside-to-vehicle communication using a beacon arranged in the vicinity of the intersection, and signal information or the like included in the infrastructure information is used. In a roadside communication system described in Patent Literature 1, signal information is created on the basis of a traffic light color displayed currently, the elapsed time of the light color, and the lighting time of each traffic light color. Simultaneously, the required communication time until a roadside device transmits the signal information to an in-vehicle device after the signal information is transmitted to the roadside device is calculated, the signal information is corrected on the basis of the required communication time, and the corrected signal information is transmitted from the roadside device to the in-vehicle device.

CITATION LIST

Patent Literature

[Patent Literature 1] Japanese Unexamined Patent Application Publication No. 2010-3306

SUMMARY OF INVENTION

Technical Problem

When a radio beacon is used to transmit infrastructure information, a vehicle can receive infrastructure information any number of times at the same intersection if the vehicle is within a range where a radio wave from the radio beacon reaches. For this reason, in the vehicle, each time the infrastructure information is received, each process using the infrastructure information is performed. With regard to signal information, the same information is transmitted other than when the signal cycle is updated (for example, when changes of light colors are decided by a traffic-actuated signal, or when a new signal cycle is added). For this reason, when the infrastructure information is received multiple times at the same intersection, and the signal information is not updated, the same process is repeatedly performed on the same signal information. Since the process for analyzing the signal information is complicated, the processing load on the signal information increases. As a result, driving support using the infrastructure cooperative service may be delayed. In the above-described patent literature, a case where the same signal information is received multiple times at the same intersection is not considered.

Accordingly, an object of the invention is to provide a roadside-to-vehicle communication system and a driving support system capable of reducing the processing load on the signal information even when the signal information is received multiple times through roadside-to-vehicle communication.

Solution to Problem

The invention provides a roadside-to-vehicle communication system which allows a vehicle, which is traveling within a roadside-to-vehicle communication area, to receive signal information from a roadside device multiple times. The roadside-to-vehicle communication system includes determination means for determining whether or not new information is added to the signal information transmitted from the roadside device, and update means for, only when the determination means determines that new information is added to the signal information, updating the signal information which is used on the vehicle side.

In this roadside-to-vehicle communication system, signal information is transmitted from the roadside device at a predetermined time interval, and the vehicle can receive the signal information from the roadside device multiple times while traveling within the roadside-to-vehicle communication area. With regard to the signal information transmitted at a predetermined time interval, the information may be updated with new information, or the information may be the same as the previous information. Accordingly, in the roadside-to-vehicle communication system, the determination means determines whether or not new information is added to the signal information transmitted from the roadside device. In the roadside-to-vehicle communication system, only when the determination means determines that new information is added to the signal information, the update means updates the signal information which is used on the vehicle side. In this way, in the roadside-to-vehicle communication system, the signal information on the vehicle side is updated only when new information is added to the signal information transmitted from the roadside device. Therefore, even when signal information is received multiple times through roadside-to-vehicle communication, it is possible to reduce the processing load on the signal information.

In the roadside-to-vehicle communication system of the invention, the new information is a new signal cycle. In the roadside-to-vehicle communication system of the invention, the new information is the duration of each light color of a signal.

In the roadside-to-vehicle communication system of the invention, the determination means may determine whether or not new information is added by comparing the number of light color changes included in the signal information transmitted at different times.

In this roadside-to-vehicle communication system, the determination means compares the number of light color changes included in the signal information transmitted at different times. When new information is added to the signal information, since changes of light colors in the next signal cycle are decided, information of a minimum of three light colors (simple pattern of green→yellow→red) is added. Accordingly, when the number of light colors included in the signal information transmitted at a certain time increases, this means that new information is added to the signal information. Therefore, in the roadside-to-vehicle communication system, when the number of light color changes of signal information at a certain time is greater than the number of light color changes of previous signal information, the determination means determines that new information is added to the signal information. The update means updates the signal information, which is used on the vehicle side, on the basis of the signal information with new information. In this way, in the roadside-to-vehicle communication system, it is possible to determine whether or not new information is added to signal information with high precision by comparing the number of light color changes included in signal information at different times. The signal information which is used for the determination may be the signal information transmitted from the roadside device or the signal information which is used on the vehicle side.

In the roadside-to-vehicle communication system of the invention, the determination means may determine whether or not new information is added by comparing the number of light colors in which a minimum remaining time and a maximum remaining time of a display remaining time of each light color in the signal information transmitted at different times match.

In this roadside-to-vehicle communication system, the determination means compares the number of light colors in which the minimum remaining time and the maximum remaining time of the display remaining time of each light color in the signal information transmitted at different times match. As described above, when new information is added to the signal information, changes of the light colors in the next signal cycle are decided. In particular, when the display remaining time of each light color in the next signal cycle is decided, the minimum remaining time and the maximum remaining time of the display remaining time are the same. Meanwhile, when the display remaining time of each light color in the next signal cycle is not decided, there may be a case where the minimum remaining time and the maximum remaining time of the display remaining time are different from each other (for example, a traffic-actuated signal). In this way, when the display remaining time of each light color in the next signal cycle is not decided, it is impossible to update the signal information, which is used on the vehicle side, using information with the display remaining time is not decided, in order that high-precision control is performed on the vehicle side using the signal information. Accordingly, in the roadside-to-vehicle communication system, when the number of light colors in which the minimum remaining time and the maximum remaining time in the signal information at a certain time match is greater than the number of light colors in which the minimum remaining time and the maximum remaining time in the previous signal information match, the determination means determines that new information is added to the signal information, and the update means updates the signal information, which is used on the vehicle side, on the basis of signal information appended with new information. In this way, in the roadside-to-vehicle communication system, by comparing the number of light colors in which the minimum remaining time and the maximum remaining time in the signal information at different times match each other, it is possible to determine whether or not the signal information which is used on the vehicle side can be updated using information newly added to the signal information. The signal information which is used for the determination may be the signal information transmitted from the roadside device or the signal information which is used on the vehicle side.

In the roadside-to-vehicle communication system of the invention, the determination means may determine whether or not new information is added on the basis of an information update flag appended to the signal information transmitted from the roadside device.

In this roadside-to-vehicle communication system, the information update flag is appended to the signal information transmitted from the roadside device, such that it is possible to determine whether or not new information is added to the signal information and the information is updated by the information update flag. Accordingly, in the roadside-to-vehicle communication system, the determination means determines whether or not new information is added on the basis of the information update flag appended to the signal information. In this way, in the roadside-to-vehicle communication system, the information update flag appended to the signal information is used, thereby determining whether or not new information is added to the signal information with ease and high precision.

The invention provides a driving support system which, in a roadside-to-vehicle communication system which allows a vehicle traveling within a roadside-to-vehicle communication area to receive signal information from a roadside device multiple times, performs driving support on the basis of the signal information received by the vehicle from the roadside device. Driving support is performed on the basis of the signal information which is used on the vehicle side and updated by the update means of the above-described roadside-to-vehicle communication system. In this driving support system, since the signal information on the vehicle side is updated only when new information is added to the signal information transmitted from the roadside device, even when the signal information is received multiple times in the roadside-to-vehicle communication, it is possible to reduce the processing load on the signal information, thereby reducing the processing load in driving support and to suppress delay of driving support as much as possible.

Advantageous Effects of Invention

According to the invention, since the signal information on the vehicle side is updated only when new information is added to the signal information transmitted from the roadside device, even when the signal information is received multiple times in the roadside-to-vehicle communication, it is possible to reduce the processing load on the signal information.

DESCRIPTION OF EMBODIMENTS

Figure 1:
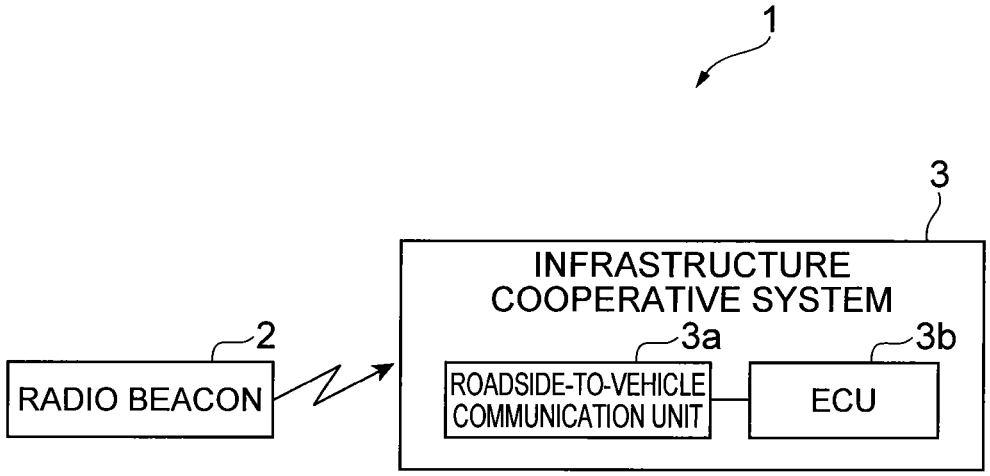
FIG. 1 is a configuration diagram of a roadside-to-vehicle communication system of this embodiment.

Hereinafter, an embodiment of a roadside-to-vehicle communication system and a driving support system according to the invention will be described with reference to the drawings. In the respective drawings, the same or corresponding elements are represented by the same reference numerals, and overlapping description will be omitted.

In this embodiment, the invention is applied to a roadside-to-vehicle communication system using a radio beacon. The roadside-to-vehicle communication system of this embodiment is a system which is used for an infrastructure cooperative service at a service-target intersection. This system distributes infrastructure information from a radio beacon (roadside device) arranged at each service-target intersection, and the vehicle mounted with the roadside-to-vehicle communication unit which is traveling within an area where a radio wave from the radio beacon reaches (within a roadside-to-vehicle communication area) receives the infrastructure information. Each vehicle of this embodiment includes an infrastructure cooperative system, and if the infrastructure information is received by the roadside-to-vehicle communication unit from the radio beacon, performs an infrastructure cooperative service (driving support) at the service-target intersection using the infrastructure information. In this embodiment, the signal information of the infrastructure information will be described in detail, and with regard to the infrastructure cooperative system of the vehicle, only a process on the signal information will be described in detail.

A roadside-to-vehicle communication system 1 of this embodiment will be described with reference to FIG. 1. FIG. 1 is a configuration diagram of the roadside-to-vehicle communication system of this embodiment.

The roadside-to-vehicle communication system 1 has a radio beacon 2 which is provided on the roadside, and an infrastructure cooperative system 3 which is mounted in each vehicle. The radio beacon 2 is provided in the vicinity of an intersection for each service-target intersection. The roadside-to-vehicle communication system 1 can perform information communication between the radio beacon 2 and each vehicle (in particular, the roadside-to-vehicle communication unit 3*a* of the infrastructure cooperative system 3) by radio waves, and transmits at least infrastructure information from the radio beacon 2 to the vehicle.

The radio beacon 2 generates infrastructure information corresponding to a service-target intersection at a given time interval, converts the infrastructure information to a radio wave signal, and distributes the radio wave signal. The infrastructure information is generated by combining intersection information (for example, stop line position information, intersection shape information) and road shape information in the vicinity of the intersection held by the radio beacon 2, various kinds of detection information (for example, detection information of pedestrians, vehicles, or the like) received from various sensors provided in the vicinity of the intersection, signal information received from a central control device of a traffic signal or a control device of each traffic signal, and the like.

The signal information includes the light color (current light color) being currently displayed, the elapsed time of the current light color, the display remaining time (duration) of each light color (green, yellow, red) in a signal cycle in which a light color change is decided. When a traffic signal has an arrow light signal (at least one of an arrow light for straight, an arrow light for right turn, and an arrow light for left turn), information relating to the arrow light is appended to be set for each color. The display remaining time of each light color has the minimum remaining time and the maximum. When the display remaining time is decided, the minimum remaining time and the maximum remaining time are the same. In a traffic-actuated signal or the like, when the display remaining time is not decided, the minimum remaining time and the maximum remaining time are different.

The signal information is generated on the basis of information (when there is an arrow light signal, including information of the arrow light) and the current light color at a give time interval in the central control device which manages traffic signals in a predetermined area or the control device of each traffic signal. With regard to the signal information, each time changes of the light colors (when there is an arrow light signal, including the arrow light) in the signal cycle next to the decided signal cycle are decided, the display remaining time of each light color in the next signal cycle is newly added. The timing at which changes of the light colors in the next signal cycle are decided is, for example, when changes of the light colors in a traffic-actuated signal are decided or when a new signal cycle is added. With regard to the signal information, even when information of a new signal cycle is not added, the elapsed time of the current light color is updated at a given time interval. When the current light color is switched to the next light color, the current light color is updated.

The infrastructure cooperative system 3 receives infrastructure information from the radio beacon 2 at each service-target intersection, and performs various infrastructure cooperative services (for example, intersection collision prevention, collision prevention with pedestrian or the like, signal oversight prevention) on the basis of the infrastructure information. In this embodiment, only a process relating to the signal information of the infrastructure information in the infrastructure cooperative system 3 will be described in detail. As a configuration necessary for this process, the infrastructure cooperative system 3 includes a roadside-to-vehicle communication unit 3*a* and an ECU [Electronic Control Unit] 3*b*. In this embodiment, each process in the ECU 3*b* corresponds to determination means and update means described in the appended claims.

The roadside-to-vehicle communication unit 3*a* is a communication unit which performs roadside-to-vehicle communication with the radio beacon 2. In the roadside-to-vehicle communication unit 3*a*, if a vehicle enters the distributable range of the radio beacon 2 at each service-target intersection, a radio wave is received from the radio beacon 2 at a given time interval, and infrastructure information is extracted from the radio signal and transmitted to the ECU 3*b*.

The ECU 3*b* is an electronic control unit which includes a CPU [Central Processing Unit], a ROM [Read Only Memory], a RAM [Random Access Memory], and the like, and performs overall control of the infrastructure cooperative system 3. In this embodiment, only a process relating to the signal information of the infrastructure information in the ECU 3*b* will be described in detail.

In the ECU 3*b*, each time the infrastructure information is received by the roadside-to-vehicle communication unit 3*a*, it is determined whether or not the signal information of the infrastructure information can be received. When the signal information can be received currently, in the ECU 3*b*, it is determined whether or not a traffic light color table is generated by the previous processes on the basis of the signal information received previously.

The traffic light color table is signal information which is used on the vehicle side. When generating the traffic light color table, the received signal information is analyzed, and a table in which intended light colors and the display remaining times thereof are stored in sequence in accordance with signal cycles starting with a light color being currently displayed is generated. When the traffic signal has an arrow light signal, information relating to the arrow light is appended to be set for each light color. For the process of various infrastructure cooperative services in the ECU 3*b*, the latest generated traffic light color table is used.

When the traffic light color table is generated by the previous processes, in the ECU 3*b*, it is determined whether or not information of a new signal cycle is added to the signal information received currently. The determination method will be described below in detail. When the traffic light color table is not yet generated or when information of a new signal cycle is added to the signal information received currently while the traffic light color table is generated, in the ECU 3*b*, the traffic light color table is generated on the basis of the signal information received currently.

When the signal information cannot be received currently, in the ECU 3*b*, it is determined whether or not the traffic light color table is generated by the previous processes on the basis of the signal information received previously. When the traffic light color table is not yet generated, in the ECU 3*b*, since there is no traffic light color table, the process for the infrastructure cooperative service using the traffic light color table is not performed.

When the traffic light color table is generated by the previous processes (in particular, when information of a new signal cycle is not added while the signal information can be received), in the ECU 3*b*, the process for the infrastructure cooperative service is basically performed using the generated traffic light color table. However, when the light color being currently displayed is different from the light color displayed previously (for example, when the light color is switched from green to yellow), in the ECU 3*b*, the leading light color in the traffic light color table is deleted, and the subsequent light color is changed to the leading light color (current light color) to update the traffic light color table. The determination on whether or not the light color being displayed currently is different from the light color displayed previously is made by comparing whether the end time of the leading light color of the traffic light color table with the current time and determining whether or not the end time of the leading light color is prior to the current time.

The determination method on whether or not new signal cycle information is added to the signal information received currently will be described. This determination method includes a first method which uses a flag appended to the signal information and a second method which uses a change between the current and previous signal information (signal information transmitted at different times).

The first method will be described. According to this method, in a control device which generates signal information or the radio beacon 2, a signal cycle update flag is appended to the signal information. For example, when new signal cycle information is appended to the signal information, the signal cycle update flag is set to 1, and when the new signal cycle information is not appended to the signal information, the signal cycle update flag is set to 0. In the ECU 3*b*, each time the signal information is received, it is determined whether or not the new signal cycle information is added to the signal information received currently on the basis of the signal cycle update flag.

The second method will be described. According to this method, there are two steps (Step 1 and Step 2). It may be determined whether or not the condition of one of the two steps is satisfied (in this case, the determination of the two steps may be made or only the determination of one step may be made), or whether or not the conditions of the two steps are satisfied.

Step 1 will be described. In the ECU 3*b*, each time the signal information is received, the number of light color changes in the signal information received previously is counted, and the number of light color changes in the signal information received currently is counted. The ECU 3*b* compares the number of light color changes in the signal information received previously with the number of light color changes in the signal information received currently. When the number of light color changes in the signal information received currently is greater than the number of light color changes in the signal information received previously, it is determined that the new signal cycle information is added to the current signal information (in particular, changes of the light colors in the new signal cycle are decided).

In the signal information, while information of some light colors for one cycle is not added, all kinds of information for one cycle when the light color pattern for one cycle is entirely decided are added. Accordingly, when the light color pattern for one cycle is decided, information for a minimum three light colors (a simple pattern of green→yellow→red) is added, and the number of light color changes thus increases by a minimum of 3. Even if the light color being displayed currently is just changed and the number of light color changes decreases by 1 between the previous and current signal information, as described above, when the light color pattern for one cycle is decided, it is assured that the number of light color changes increases.

Step 2 will be described. In the ECU 3*b*, each time the signal information is received, the number of light colors in which the minimum remaining time and the maximum remaining time of the display remaining time for each light color of the signal information received previously match each other is counted, and the number of light colors in which the minimum remaining time and the maximum remaining time of the display remaining time for each light color of the signal information received currently match each other is counted. The ECU 3*b* compares the number of light colors in which the minimum remaining time and the maximum remaining time in the previous signal information match each other with the number of light colors in which the minimum remaining time and the maximum remaining time in the current signal information match each other. When the number of light colors in which the minimum remaining time and the maximum remaining time in the current signal information match each other is greater than the number of light colors in which the minimum remaining time and the maximum remaining time in the previous signal information match each other, it is determined that the new signal cycle information is added to the current signal information (in particular, the display remaining time of each light color in the new signal cycle is decided).

Even when changes of the light colors in the new signal cycle are decided, the display remaining time of each light color in a traffic-actuated signal or the like may not be decided. In this case, the minimum remaining time and the maximum remaining time of the display remaining time are different from each other. When the display remaining time of each light color is not decided, it is impossible to provide a high-precision infrastructure cooperative service using the new signal cycle information. Meanwhile, when changes of the light colors in the new signal cycle are decided and the display remaining time of each light color is also decided, the minimum remaining time and the maximum remaining time of the display remaining time are the same. Accordingly, when the number of light colors in which the minimum remaining time and the maximum remaining time match each other increases from the previous time to the current time, it can be determined that light color changes in the new signal cycle are decided and the display remaining time of each light color is decided. In this way, the traffic light color table is generated using information in which the display remaining time of each light signal is decided, thereby providing a high-precision infrastructure cooperative service using the traffic light color table.

In the determination of Step 1 and Step 2, the signal information included in the infrastructure information may be used, or the traffic light color table which is generated by the ECU 3*b* may be used.

Figure 2:
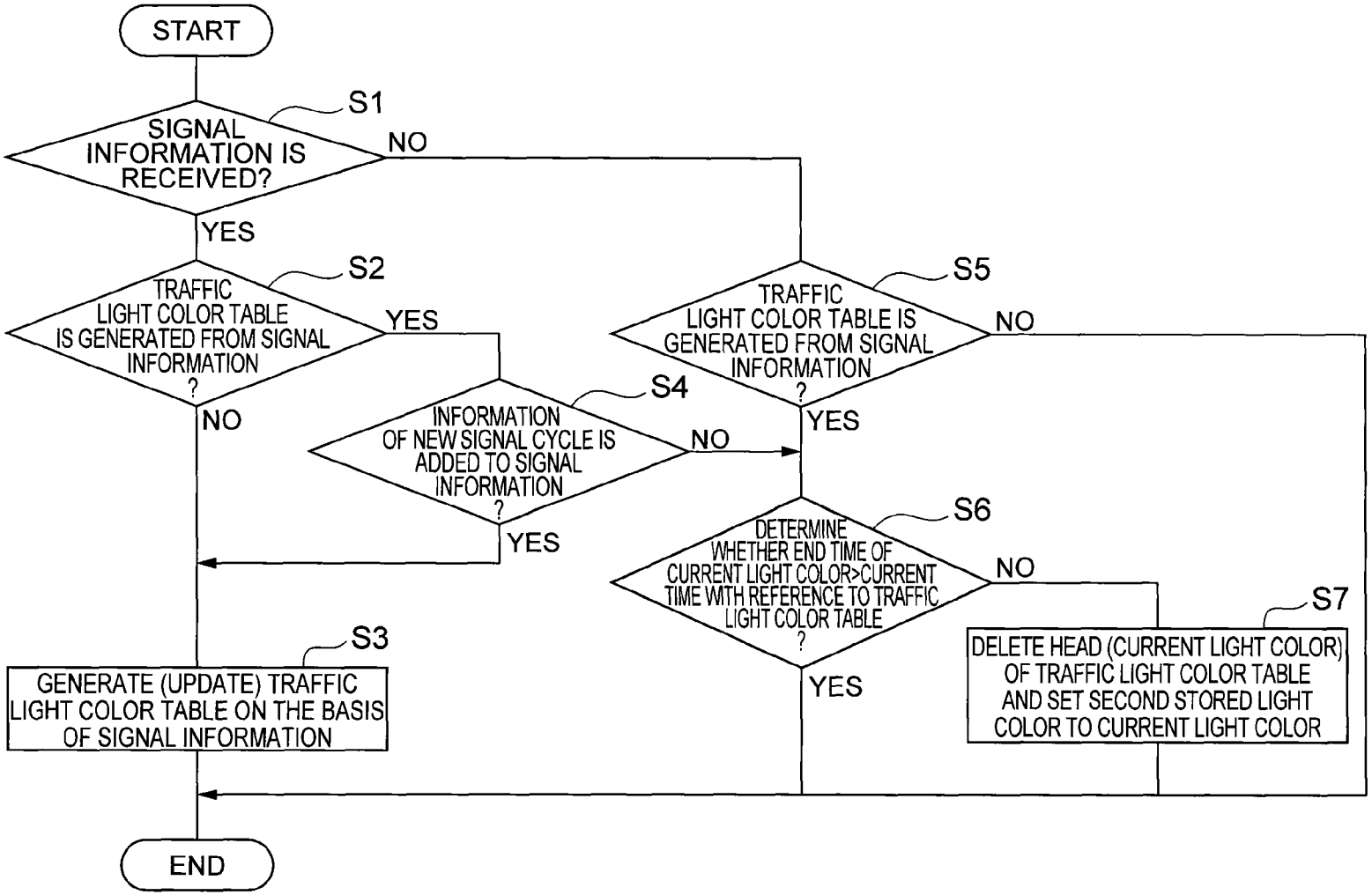
FIG. 2 is a flowchart of a process relating to signal information in an ECU of the infrastructure cooperative system of FIG. 1.

The operation of the roadside-to-vehicle communication system 1 will be described with reference to FIG. 1. In particular, a process in the ECU 3*b* of the infrastructure cooperative system 3 will be described with reference to a flowchart of FIG. 2. FIG. 2 is a flowchart of a process relating to signal information in the ECU of the infrastructure cooperative system of FIG. 1.

In the radio beacon 2 at each service-target intersection, infrastructure information is generated at a given time interval using held intersection information and road shape information in the intersection, various kinds of detection information received from various sensors, signal information received from a traffic signal control device, and the like, and the infrastructure information is distributed as a radio wave.

If each vehicle enters the distributable area of the radio beacon 2, the radio signal from the radio beacon 2 is received by the roadside-to-vehicle communication unit 3*a*, and the infrastructure information is transmitted to the ECU 3*b*.

In the ECU 3*b*, it is determined whether or not the signal information can be received currently on the basis of the infrastructure information at a given time interval (S1). When it is determined in S1 that the signal information can be received currently, in the ECU 3*b*, it is determined whether or not the traffic light color table is generated from the signal information by the previous processes (S2). When it is determined in S2 that the traffic light color table is not generated, in the ECU 3*b*, the traffic light color table is generated (updated) on the basis of the current signal information (S3), and the current process ends. In this case, in the infrastructure cooperative service, the newly generated traffic light color table is used.

When it is determined in S2 that the traffic light color table is generated, in the ECU 3*b*, it is determined whether or not new signal cycle information is added to the current signal information (S4). When it is determined in S4 that the new signal cycle information is added, in the ECU 3*b*, the traffic light color table is generated (updated) on the basis of the current signal information (S3), and the current process ends. In this case, in the infrastructure cooperative service, the newly generated traffic light color table (in particular, added with the new signal cycle information) is used.

When it is determined in S1 that the signal information cannot be received currently, in the ECU 3*b*, it is determined whether or not the traffic light color table is generated from the signal information by the previous processes (S5). When it is determined in S5 that the traffic light color table is not generated, in the ECU 3*b*, the current process ends. In this case, since the traffic light color table is not yet generated, the infrastructure cooperative service using the traffic light color table is not performed.

When it is determined in S4 that the new signal cycle information is not added or when it is determined in S5 that the traffic light color table is generated, in the ECU 3*b*, the traffic light color table is referenced, and it is determined whether or not the end time of the current light color (leading light color) in the traffic light color table is after the current time (S6). When it is determined in S6 that the end time of the current light color is after than the current time, in the ECU 3*b*, the current process ends. In this case, in the infrastructure cooperative service, the generated traffic light color table is used directly.

When it is determined in S6 that the end time of the current light color is prior to the current time, in the ECU 3*b*, the leading light color (current light color) of the traffic light color table is deleted, and the next light color is set as the current light color to update the traffic light color table (S7). Then, the current process ends. In this case, in the infrastructure cooperative service, the updated traffic light color table is used.

According to the roadside-to-vehicle communication system 1 (in particular, the ECU 3*b* of the infrastructure cooperative system 3), the traffic light color table is updated on the vehicle side only when the new signal cycle information is added to the signal information transmitted from the radio beacon 2. For this reason, even when the signal information is received multiple times in the roadside-to-vehicle communication at the same service-target intersection, it is possible to reduce the load of the process (the process for analyzing the signal information and generating the traffic light color table) on the signal information without performing the process on the signal information multiple times. With the reduction in the processing load, it is also possible to reduce the processing load in driving support of the infrastructure cooperative service using the traffic light color table, and to suppress delay of driving support as much as possible.

According to the roadside-to-vehicle communication system 1, the signal cycle update flag appended to the signal information is used, thereby determining whether or not new information in a new signal cycle is added to the signal information with ease and high precision. According to the roadside-to-vehicle communication system 1, by comparing the number of light color changes between the previous and current signal information, it is possible to determine whether or not changes of the light colors in the new signal cycle are decided, and to determine whether or not the new signal cycle information is added to the signal information with high precision. According to the roadside-to-vehicle communication system 1, by comparing the number of light colors in which the minimum remaining time and the maximum remaining time match each other between the previous and current signal information, it is possible to determine whether or not the display remaining time of each light color of the newly added signal cycle information is decided with high precision, and to determine whether or not the traffic light color table can be updated using the signal information with the new signal cycle information with high precision.

Although the embodiment of the invention has been described, the invention is not limited to the foregoing embodiment and may be carried out in various forms.

For example, although in this embodiment, the invention is applied to the roadside-to-vehicle communication system which is used for an infrastructure cooperative server, the invention may be applied to other roadside-to-vehicle communication systems. Although a configuration in which the roadside-to-vehicle communication system includes the radio beacon and the infrastructure cooperative system on the vehicle side is made, a different configuration may be made. For example, a system other than an infrastructure cooperative system may be applied on the vehicle side, or if the vehicle which is traveling within the roadside-to-vehicle communication area can receive the signal information multiple times, a roadside device other than a radio beacon may be applied.

Although in this embodiment, a configuration in which each process relating to the signal information is performed in the vehicle has been described, each process may be performed in a center or a control device which generates signal information to be transmitted from the roadside device, or may be performed in the roadside device.

Although in this embodiment, an example of the format of the signal information transmitted from the roadside device has been described, signal information in other formats may be used. Although in this embodiment, an example (traffic light color table) of the format of the signal information which is used in the vehicle has been described, signal information in other formats may be used.

Although in this embodiment, two methods have been described as the determination method on whether or not information in a new signal cycle is added to signal information, other determination methods may be used.

INDUSTRIAL APPLICABILITY

In the roadside-to-vehicle communication system which allows the vehicle, which is traveling within the roadside-to-vehicle communication area, to receive the signal information from the roadside device multiple times, since the signal information on the vehicle side is updated only when new information is added to the signal information transmitted from the roadside device, even when the signal information is received multiple times in the roadside-to-vehicle communication, it is possible to reduce the processing load on the signal information.

REFERENCE SIGNS LIST

1: roadside-to-vehicle communication system, 2: radio beacon, 3: infrastructure cooperative system, 3*a*: roadside-to-vehicle communication unit, 3*b*: ECU.

The invention claimed is:

1. A roadside-to-vehicle communication system which allows a vehicle, which is traveling within a roadside-to-vehicle communication area, to receive signal information from a roadside device multiple times, the roadside-to-vehicle communication system comprising:

determination means for determining whether or not new information is added to the signal information transmitted from the roadside device; and update means for, only when the determination means determines that the new information is added to the signal information, updating the signal information which is used on the vehicle side wherein the determination means determines whether or not the new information is added by comparing the number of light color changes included in the signal information transmitted at different times.

2. The roadside-to-vehicle communication system according to claim 1, wherein the new information is a new signal cycle.

3. The roadside-to-vehicle communication system according to claim 1, wherein the new information is the duration of each light color of a signal.

4. The roadside-to-vehicle communication system according to claim 1, wherein the determination means determines whether or not the new information is added by comparing the number of light colors in which a minimum remaining time and a maximum remaining time of a display remaining time of each light color in the signal information transmitted at different times match each other.

5. A driving support system which, in a roadside-to-vehicle communication system which allows a vehicle traveling within a roadside-to-vehicle communication area to receive signal information from a roadside device multiple times, performs driving support on the basis of the signal information received by the vehicle from the roadside device, wherein the driving support is performed on the basis of the signal information which is used on the vehicle side and updated by the update means of the roadside-to-vehicle communication system according to claim 1.

* * * * *